US011760617B2

(12) United States Patent
Abelli et al.

(10) Patent No.: US 11,760,617 B2
(45) Date of Patent: Sep. 19, 2023

(54) FILLING DEVICE FOR FILLING A RECEPTACLE AND PROCESS FOR THE SANITISATION THEREOF

(71) Applicant: GEA PROCOMAC S.P.A., Sala Baganza (IT)

(72) Inventors: Paolo Abelli, Parma (IT); Simone Antiga, Langhirano (IT); Michele Bonfanti, Collecchio (IT)

(73) Assignee: GEA PROCOMAC S.P.A., Sala Baganza (IT)

( * ) Notice: Subject to any disclaimer, the term of this patent is extended or adjusted under 35 U.S.C. 154(b) by 5 days.

(21) Appl. No.: 17/414,621

(22) PCT Filed: Nov. 20, 2019

(86) PCT No.: PCT/IB2019/059980
§ 371 (c)(1),
(2) Date: Jun. 16, 2021

(87) PCT Pub. No.: WO2020/128678
PCT Pub. Date: Jun. 25, 2020

(65) Prior Publication Data

US 2022/0063979 A1 Mar. 3, 2022

(30) Foreign Application Priority Data

Dec. 21, 2018 (IT) ..... 102018000020926

(51) Int. Cl.
*B67C 3/00* (2006.01)
*B67C 3/28* (2006.01)

(52) U.S. Cl.
CPC ..... *B67C 3/001* (2013.01); *B67C 3/281* (2013.01); *B67C 3/286* (2013.01)

(58) Field of Classification Search
CPC ..... F16K 3/246; B67C 3/002; B67C 3/005
USPC ..... 141/89, 90
See application file for complete search history.

(56) References Cited

U.S. PATENT DOCUMENTS

| | | | |
|---|---|---|---|
| 4,716,921 A | 1/1988 | Rangwala et al. | |
| 6,375,050 B1 | 4/2002 | Gruson | |
| 11,040,861 B2 * | 6/2021 | Baumgartner | B67C 3/001 |

(Continued)

FOREIGN PATENT DOCUMENTS

| | | |
|---|---|---|
| EP | 0242119 A1 | 10/1987 |
| EP | 0780338 A1 | 6/1997 |

(Continued)

*Primary Examiner* — Timothy P. Kelly
*Assistant Examiner* — Christopher M Afful
(74) *Attorney, Agent, or Firm* — PEARNE & GORDON LLP

(57) ABSTRACT

Sanitisation process for sanitising a filling device (1) of a receptacle, the filling device (1) comprising a valve body (2), an inlet (4) for a fluid, a dispensing nozzle (5), and a shutter (8) that can be moved inside the valve body (2), comprising the steps of:

bringing the shutter (8) into a position whereby it engages the dispensing nozzle (5) so as to close it completely;

supplying the inlet (4) with the sanitisation fluid so as to fill the valve body (2) with the sanitisation fluid;

moving the shutter (8) away from the dispensing nozzle (5) so as to discharge the condensation that has formed inside the valve body (2).

11 Claims, 3 Drawing Sheets

(56) References Cited

U.S. PATENT DOCUMENTS

| | | | | |
|---|---|---|---|---|
| 11,649,151 | B2 * | 5/2023 | Clüsserath | B67C 3/286 141/6 |
| 2004/0188652 | A1 | 9/2004 | Miyazaki et al. | |
| 2006/0261300 | A1 | 11/2006 | Merabet et al. | |
| 2007/0215830 | A1 * | 9/2007 | Norton | F16K 1/446 251/205 |
| 2008/0083474 | A1 | 4/2008 | Mazzon | |
| 2015/0152972 | A1 * | 6/2015 | D'Errico | F16K 31/082 251/65 |
| 2018/0170741 | A1 * | 6/2018 | Krulitsch | B67C 3/26 |

FOREIGN PATENT DOCUMENTS

| | | | | |
|---|---|---|---|---|
| EP | 1277694 | A2 | 1/2003 | |
| EP | 1433738 | A1 | 6/2004 | |
| EP | 1908726 | A1 | 4/2008 | |
| EP | 2409948 | A2 | 1/2012 | |
| EP | 2768764 | A1 | 8/2014 | |
| EP | 2821362 | A1 | 1/2015 | |
| EP | 2881636 | A1 | 6/2015 | |
| FR | 2983843 | A1 | 6/2013 | |
| JP | H07187292 | A | 7/1995 | |
| JP | 2011116425 | A | 6/2011 | |
| JP | 2016216103 | A | 12/2016 | |
| WO | WO-9304975 | A1 * | 3/1993 | B67C 3/005 |
| WO | WO-03046951 | A2 * | 6/2003 | B29C 45/14778 |
| WO | WO-2013057694 | A1 * | 4/2013 | B67C 3/286 |
| WO | 2016171560 | A1 | 10/2016 | |
| WO | 2018104551 | A1 | 6/2018 | |

* cited by examiner

FILLING DEVICE FOR FILLING A RECEPTACLE AND PROCESS FOR THE SANITISATION THEREOF

TECHNICAL FIELD

The present invention relates to a filling device for filling a receptacle and a process for the sanitisation thereof.

The invention has application in the packaging of a food-grade fluid product (beverage), possibly containing solid pieces.

One of the fields of reference is the bottling of so-called "sensitive" food products, that is, products that are particularly sensitive to bacteriological contamination and oxidation, such as, for example isotonic beverages, juices, nectars, soft drinks, tea, milk-based beverages, coffee-based beverages, soups, broths, etc., for which it becomes fundamental to avoid, during all stages of packaging, possible microbiological contaminations.

BACKGROUND ART

In this context, the solid pieces are for example pieces of fruit or vegetables, cereals, legumes, nuts, etc.

Irrespective of the various existing solutions, a filling machine comprises a plurality of container filling stations in which there is a dosing device with a shutter that puts the product tank in selective communication with the dispensing nozzle.

A flow regulator is generally associated with each dosing device so as to pass from higher flow rates—in the initial phase of filling the receptacle—to lower flow rates, when filling is about to end. The regulation of the flow rate is performed by detecting the level of the fluid or the weight reached by the fluid in the receptacle—detection that can take place with a sensor of a known type, which transmits a suitable opening/closing signal to the shutter.

The dosing device therefore takes on at least three configurations:

- a totally closed configuration in which no product is dispensed;
- a configuration of maximum opening, in which product is dispensed at a high flow rate;
- a configuration of partial opening, in which product is dispensed at a reduced flow rate.

Periodically, the internal parts of the dosing device must undergo a sanitisation treatment.

For example, a known solution envisages supplying the dosing device with a sanitisation fluid while a dummy bottle is positioned under the dispensing nozzle and said fluid is passed through it. The fluid is then evacuated by means of a specific conduit that starts from the dummy bottle.

During the steps of filling with a food-grade fluid, the dummy bottle is moved away from the dispensing nozzle, for example by means of a specific lever mechanism (see patent EP 0780338 in the name of the Applicant).

Another solution, proposed in document EP 2409948, envisages applying a perforated guide element under the dispensing nozzle to discharge the sanitisation fluid.

The solutions just described thus use external means (dummy bottle or perforated guide element) which are positioned under the dispensing nozzle as needed, i.e. when a sanitisation treatment has to be carried out. During normal filling, said external means are moved away from the dispensing nozzle so as not to interfere with the receptacle.

The provision of such means and devices for the actuation thereof makes these solutions structurally complex and cumbersome.

WO 2018/104551 A1, in accordance with its abstract, discloses a filling device comprising at least one filler valve for metering the filler product into the container, as well as a sterilisation device for sterilising at least one part of the filler valve, a contactless temperature sensor being provided for contactlessly measuring the temperature of the filler valve.

EP 0242119 A1, in accordance with its abstract, discloses a filler sterilization system including an inlet valve, a main valve, an outlet valve, a linkage system therebetween, and a cam and follower arrangement for actuating the linkage system to move the three valves into three operating positions. The three positions are normally closed and open positions for dispensing a liquid product into a carton, and a third position for steam sterilization of the filler system. The outlet valve, in the latter position is such that a predetermined back pressure is maintained during the sterilization process.

In this context, the technical task at the basis of the present invention is to propose a filling device for filling a receptacle and a process for the sanitisation thereof which overcome the drawbacks of the prior art cited above.

DISCLOSURE OF THE INVENTION

In particular, it is an object of the present invention to propose a filling device for filling a receptacle which can be easily sanitised without having to increase its overall dimensions and/or structural complexity.

The stated technical task and specified objects are substantially achieved by a filling device for filling a receptacle, comprising:

- a tank containing a fluid;
- a valve body which mainly extends along a longitudinal direction;
- an inlet communicating with the tank;
- a dispensing nozzle for dispensing fluid to the receptacle;
- a passage for the fluid, obtained inside the valve body between the inlet and the dispensing nozzle;
- a shutter that can be moved in the valve body so as to assume at least a first position in which it is at a first predefined distance from the dispensing nozzle, a second position in which it engages the dispensing nozzle so as to close it completely and a third position in which it is at a second predefined distance from the dispensing nozzle, the filling device being configurable at least in:
- a filling status in which the tank contains a food-grade fluid and the shutter is in the first position so as to allow the dispensing nozzle to dispense the food-grade fluid to the receptacle;
- a sanitisation status in which the tank contains a sanitisation fluid and the shutter is in the second or third position.

In accordance with one embodiment, a condensate discharge status is also envisaged in which the shutter is in the third position.

The filling device preferably further comprises a slider slidably inserted in the valve body. The shutter is integrally fixed to a first end of the slider in proximity to the dispensing nozzle.

The filling device further comprises an annular sleeve slidably mounted outside the valve body and comprising a plurality of magnetic rings alternating with a plurality of ferromagnetic rings.

The slider comprises a core made of ferromagnetic material to which a coating made of thermoplastic polymer is applied.

For example, the coating is made of PEEK.

The core of the slider has a central portion having a cylindrical extension along the longitudinal direction and a plurality of radial projections having an extension orthogonal to the longitudinal direction.

Between the radial projections there are preferably spaces or gaps filled by the coating.

In accordance with one embodiment, each ferromagnetic ring faces a group of radial projections located at the same height as the slider. A wall of the valve body is interposed between the ferromagnetic ring and the radial projections of said group.

In accordance with one embodiment, the filling device comprises a flow rate selector integrally fixed to a second end of the slider and configured to assume at least one engagement configuration with a section narrowing afforded in said passage. The section narrowing is interposed between a first chamber receiving the fluid from the inlet and a second chamber receiving the fluid from the first chamber.

The filling device preferably comprises a stepper motor configured to make the annular sleeve slide on the valve body.

The stated technical task and specified objects are substantially achieved by a sanitisation process for sanitising the filling device which, in accordance with one embodiment, comprises the steps of:

- bringing the shutter into the second position whereby it engages said dispensing nozzle so as to close it completely;
- supplying the inlet with the sanitisation fluid so as to fill the valve body with the sanitisation fluid;
- bringing the shutter from the second to the third position so as to discharge the condensation that has formed inside the valve body.

For example, the step of bringing the shutter from the second to the third position is performed periodically.

Alternatively, the process comprises a step of detecting the presence of condensation inside the valve body. In this case, the shifting of the shutter from the second to the third position takes place in response to the detection of condensation.

The stated technical task and specified objects are substantially achieved by a sanitisation process for sanitising the filling device which, in accordance with a further embodiment, comprises the steps of:

- bringing the shutter into the third position;
- supplying the inlet with the sanitisation fluid so as to fill the valve body with the sanitisation fluid;
- evacuating the condensation that has formed inside the valve body.

The step of evacuating the condensation is preferably performed without further distancing the shutter from the dispensing nozzle relative to the second predefined distance.

Alternatively, the step of evacuating the condensation is performed by further distancing the shutter from the dispensing nozzle relative to the second predefined distance.

In all embodiments of the process, the second predefined distance is preferably selected so as to guarantee the maintenance of saturation pressure and temperature inside the valve body.

The process preferably further comprises a step of sterilising the dispensing nozzle from the outside of the valve body, in the direction of said shutter.

For example, the step of sterilising the dispensing nozzle from the outside of the valve body takes place by nebulising a sterilising fluid on the dispensing nozzle so that the jet is at least partially directed towards the shutter.

The step of sterilising the dispensing nozzle from the outside of the valve body preferably takes place at least partially at the same time as the step of supplying the inlet with the sanitisation fluid.

BRIEF DESCRIPTION OF DRAWINGS

Additional features and advantages of the present invention will become more apparent from the approximate and thus non-limiting description of a preferred but non-exclusive embodiment of a filling device for filling a receptacle and of the process for the sanitisation thereof, as illustrated in the accompanying drawings, in which.

DETAILED DESCRIPTION OF PREFERRED EMBODIMENTS OF THE INVENTION

Figure 1:
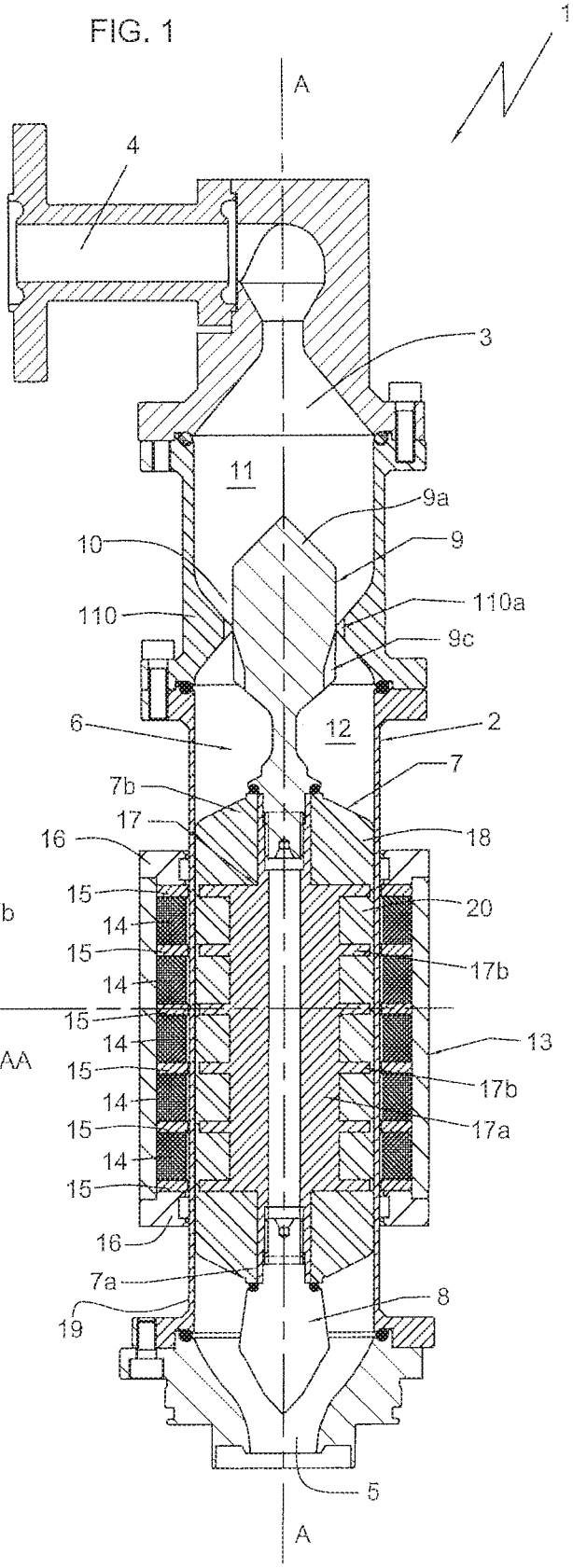
FIGS. 1, 2 and 3 illustrate a filling device for filling a receptacle, in a corresponding number of configurations, in a longitudinal section, in accordance with the present invention.

With reference to the figures, a filling device for filling a receptacle made of glass or plastic (e.g. PET) or another material has been indicated with the number 1.

The filling device 1 comprises a valve body 2 which mainly extends along a longitudinal direction AA and in which a passage 3 for a filling fluid is obtained.

The passage 3 is obtained between an inlet 4 for the fluid and a dispensing nozzle 5 for dispensing the fluid to fill the receptacle.

The fluid is supplied to the inlet from a tank 40.

Valve means 6 configured to establish a selective communication between the inlet 4 and the dispensing nozzle 5 are operatively active on the passage 3.

In the embodiment described and illustrated here, the valve means 6 comprise:

- a slider 7, having an elongate shape and extending parallel to the longitudinal direction AA, and which is slidably inserted in the valve body 2, in particular in the passage 3 between the inlet 4 and the dispensing nozzle 5;
- a shutter 8 integrally fixed to a first end 7*a* of the slider 7 in proximity to the dispensing nozzle 5;
- a flow rate selector 9 integrally fixed to a second end 7*b* of the slider 7, opposite the first end 7*a*.

In the embodiment described and illustrated here, the shutter 8 and the flow rate selector 9 are screwed to the slider 7.

The shutter 8 preferably has an ogival shape and can assume a closed configuration of the dispensing nozzle 5, in which the dispensing of fluid is prevented, and an open configuration of the dispensing nozzle 5, in which fluid is dispensed with a flow rate depending on the position of the flow rate selector 9 inside the passage 3.

In the passage 3 there is a section narrowing 10 that defines:

- a first chamber 11 receiving the filling fluid from the inlet 4;
- a second chamber 12 receiving the filling fluid from the first chamber 11.

With reference to the figures, the first chamber 11 is above the section narrowing 10 and the second chamber 12 is below the section narrowing 10.

The section narrowing 10 is defined by a thickening 110 localised transversely to the walls of the valve body 2. For example, the localised thickening defines a cusp-like shape.

The flow rate selector 9 is configured to assume at least one configuration of engagement with the section narrowing 10, in which it defines with the latter at least a minimum space 110*a*, 9*d* that puts the first chamber 11 and the second chamber 12 in fluid communication.

In accordance with a first embodiment, illustrated in FIG. 1, the minimum space 110*a* is obtained by obtaining a groove in the thickening 110 of the walls of the valve body 2. Preferably, several grooves, for example four, are obtained in the thickening 110.

Figure 5:
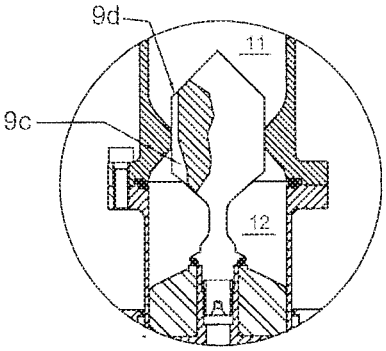
FIG. 5 illustrates a detail of the engagement between the flow rate selector and the section narrowing of the filling device of FIG. 1, in accordance with a variant embodiment.

In a variant embodiment, illustrated in FIG. 5, the minimum space 9*d* is obtained by affording a grooved recess on the outside surface of the flow rate selector 9. The grooved recess follows the longitudinal extension of the flow rate selector 9.

Preferably, in fact, the flow rate selector 9 comprises a body of an elongate shape with a first ogival end 9*a* which is tapered in the direction of the first chamber 11 and a second ogival end 9*b* which is tapered in the direction of the second chamber 12.

In order to increase the passage space (i.e. to make it larger than the minimum space), the flow rate selector 9 can also have a grooved recess 9*c* in the area of the second ogival end 9*b*.

In an alternative embodiment, the second ogival end 9*b* has a greater taper than the first ogival end 9*a*.

Figure 2:
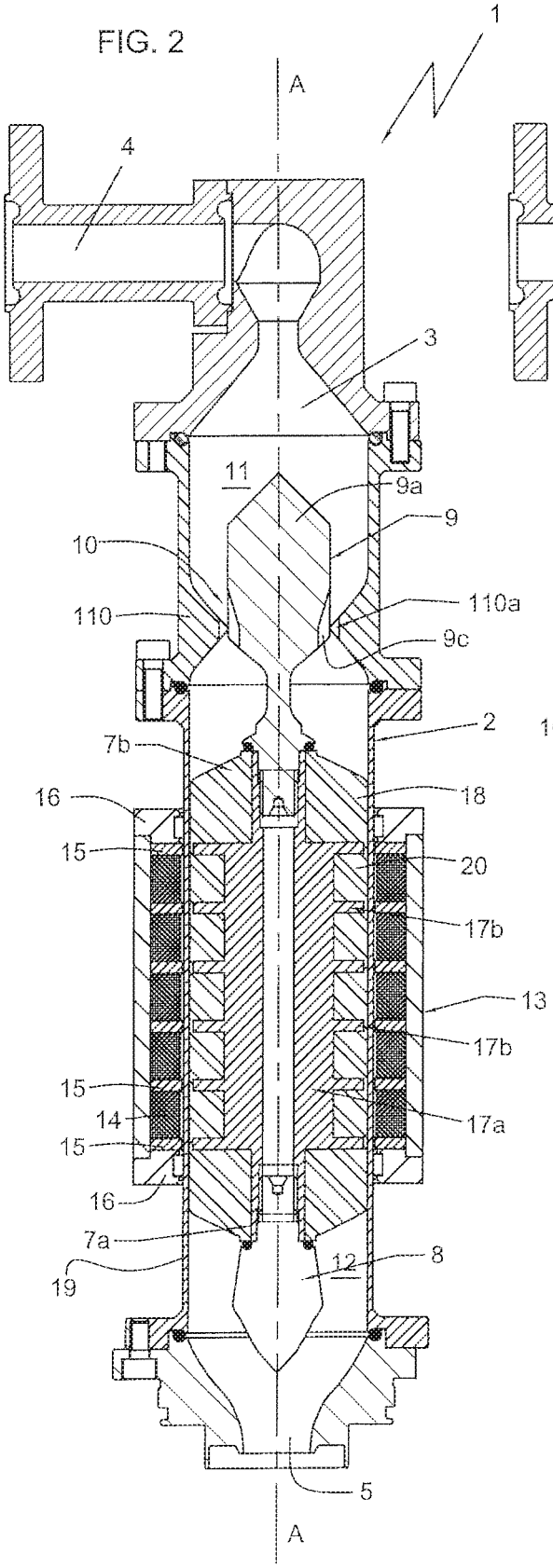
Figure 3:
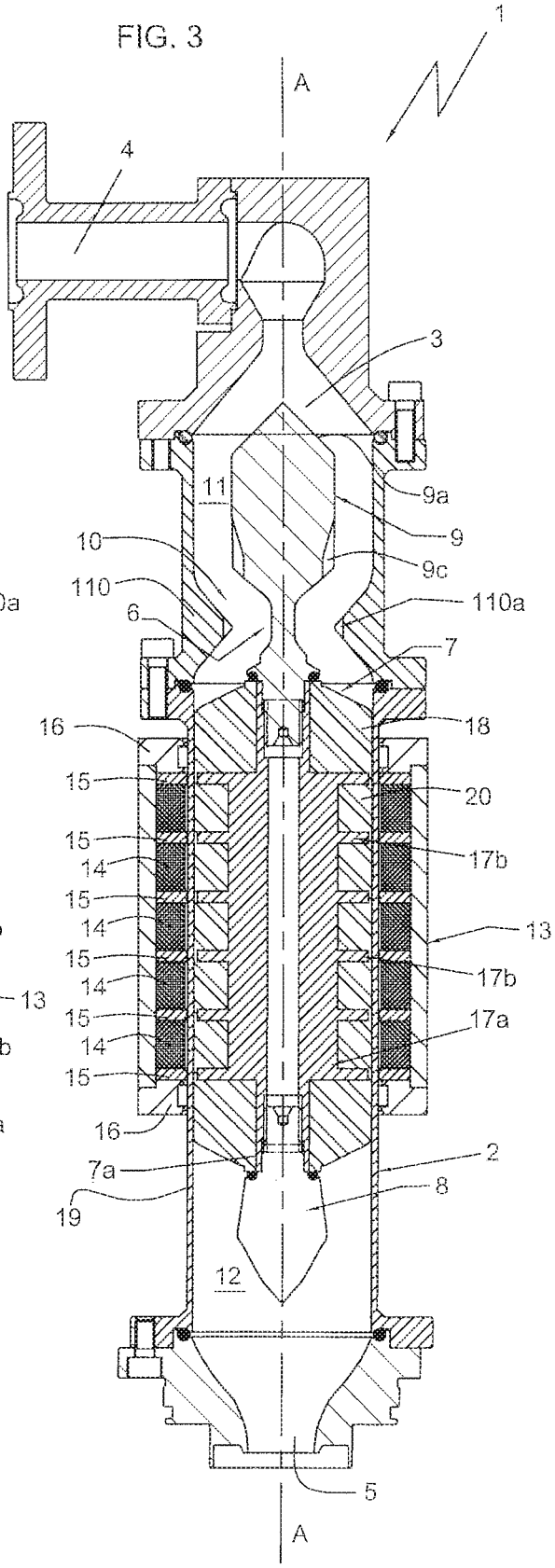

As a result of the sliding of the slider 7 in the valve body 2, during filling of the receptacle, the flow rate selector 9 can assume at least three configurations:

- a first engagement configuration in which the flow rate selector 9 engages the section narrowing 10 defining the minimum space 110*a*, 9*d* (see FIG. 1 or FIG. 5).
- a second engagement configuration in which the flow rate selector 9 engages the section narrowing 10 defining a space that is larger than the minimum one (see FIG. 2);
- a third configuration in which the flow rate selector 9 does not engage the section narrowing 10 and is positioned in the first chamber 11 (see FIG. 3).

In particular:

- in the first engagement configuration the flow rate selector 9 is positioned, preferably halfway, between the first chamber 11 and the second chamber 12 (see FIG. 1 or FIG. 5);
- in the second engagement configuration the flow rate selector 9 is mainly positioned in the first chamber 11 (see FIG. 2);
- in the third configuration the flow rate selector 9 is entirely positioned in the first chamber 11 (see FIG. 3).

In all three configurations, the flow rate selector 9 is positioned with the first ogival end 9*a* in the first chamber 11.

In the first and second configurations the flow rate selector 9 is positioned with the second ogival end 9*b* at least partially in the second chamber 12, whereas in the third configuration the second ogival end 9*b* is in the first chamber 11.

In particular, in the second configuration, the second ogival end 9*b* is partially in the second chamber 12.

In the first configuration, by contrast, the second ogival end 9*b* is entirely in the second chamber 12.

The filling device 1 comprises an annular sleeve 13 slidably mounted on the outside of the valve body 2.

In particular, the annular sleeve 13 is coaxial with the valve body 2.

The sliding thereof on the valve body 2 is obtained by means of a stepper motor (not illustrated).

Advantageously, the annular sleeve 13 comprises a plurality of magnetic rings 14 (i.e. formed from permanent magnets) alternating with a plurality of ferromagnetic rings 15.

In particular, the magnetic rings 14 and the ferromagnetic rings 15 are packed in a box-like container 16 made of a non-ferromagnetic material.

The slider 7 is magnetically coupled to the annular sleeve 13 thanks to the fact that it comprises a core 17 made of ferromagnetic material to which a coating 18 made of thermoplastic polymer is applied.

For example, the coating 18 is made of PEEK.

In particular, the core 17 is concentric to and coaxial with the valve body 2.

The core 17 preferably has a central portion 17*a* having a cylindrical extension along the longitudinal direction AA and a plurality of radial projections 17*b* having an extension orthogonal to the longitudinal direction AA.

In particular, the radial projections 17*b* are distributed along the longitudinal extent of the central portion 17*a*, that is to say, they are distributed along the length of the central portion 17*a*.

The radial projections 17*b* are preferably equally spaced.

In this context, it should be understood that the radial projections 17*b* are equally spaced both angularly, relative to an axis of symmetry of the central portion 17*a* (which can coincide with the longitudinal direction AA previously introduced), and longitudinally, i.e. in their extension for the length of the central portion 17*a*.

For example, each radial projection 17*b* consists in a fin or tooth extending radially from the central portion 17*a*.

Figure 4:
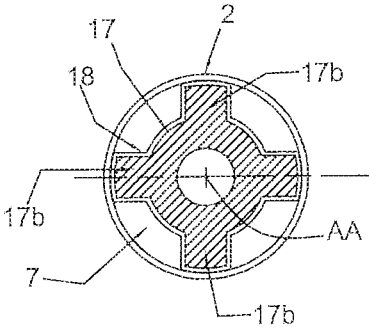
FIG. 4 illustrates an element (slider) of the filling device of FIGS. 1-3, in a cross section.

In the embodiment described and illustrated here, the fins or teeth that extend at the same height as the slider 7 define a cross-shaped structure, as may be seen in FIG. 4.

The spaces or gaps 20 between the radial projections 17*b* are filled by the coating 18 made of thermoplastic polymer.

Advantageously, each ferromagnetic ring 15 of the annular sleeve 13 faces a group of radial projections 17*b* located at the same height as the slider 7.

The thickness of the radial projections 17*b* is substantially identical to the thickness of the ferromagnetic rings 15.

Each magnetic ring 14 faces the spaces or gaps 20 filled by the coating 18.

The thickness of the spaces or gaps 20 is substantially identical to the thickness of the magnetic rings 14.

The alignment of each ferromagnetic ring 15 with a group of radial projections 17*b* enables the passage of the lines of force of the magnetic field to be maximised.

A wall 19 of the valve body 2, made of non-ferromagnetic material, is interposed between the annular sleeve 13 and the slider 7.

In a variant embodiment, the valve means 6 could also be of a type other than the one described and illustrated up to now.

In particular, the valve means 6 could consist in a slider 7 with a coaxial conduit passing through it which performs the function of restricting the flow rate, as in document EP 2768764.

In accordance with one embodiment, the magnetic coupling between the slider 7 and the annular sleeve 13 allows the slider 7 to be moved in such a way that the flow rate selector 9 can assume infinite positions between the first and second engagement configurations. In other words, the slider 7 is moved in a continuous and gradual, i.e. non-discrete, manner.

In accordance with another embodiment, the flow rate selector 9 can assume a discrete number of positions between the first and second engagement configurations.

Furthermore, the magnetic coupling between the slider 7 and the annular sleeve 13 allows the slider 7 to be moved in such a way that the shutter 8 can assume at least:

- a first position in which it is at a first predefined distance from the dispensing nozzle 5;
- a second position in which it engages the dispensing nozzle 5 so as to close it completely;
- a third position in which it is at a second predefined distance from the dispensing nozzle 5, less than the first predefined distance.

In particular, the first position of the shutter 8 is compatible with a filling status in which the tank 40 contains a food-grade fluid which is introduced into the inlet 4. Being in the first position, the shutter 8 allows the dispensing nozzle 5 to dispense the food-grade fluid to the receptacle. The first predefined distance is defined on the basis of the specific filling step, that is, one of the steps of FIG. 1, 2 or 3, which refers to different fluid flow rates.

Figure 6:
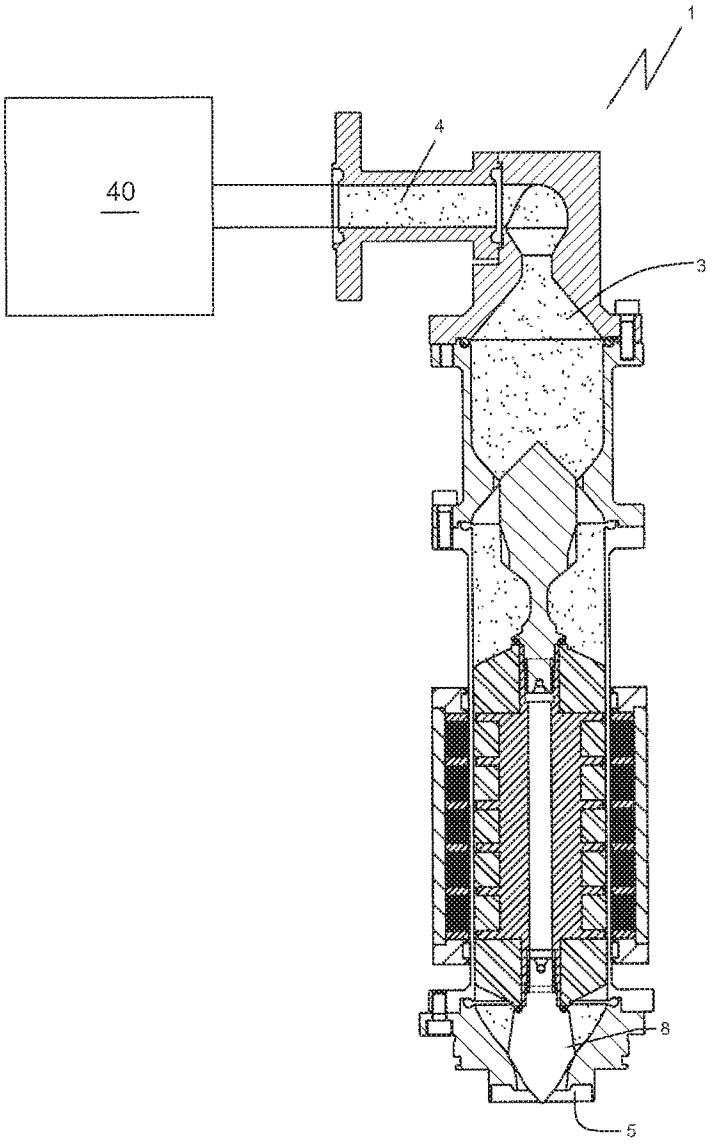
FIG. 6 illustrates the filling device of FIG. 1-3 in a sanitisation status.

The second position of the shutter 8 is compatible with a sanitisation status in which the tank 40 contains a sanitisation fluid. This situation is illustrated in FIG. 6.

In accordance with a first embodiment, the sanitisation process for sanitising the filling device 1 comprises the steps of:

- bringing the shutter 8 into the second position whereby it engages said dispensing nozzle 5 so as to close it completely;
- supplying the inlet 4 with the sanitisation fluid so as to fill the valve body 2 with said fluid;
- bringing the shutter 8 from the second to the third position so as to discharge the condensation that has formed inside the valve body 2.

Figure 7:
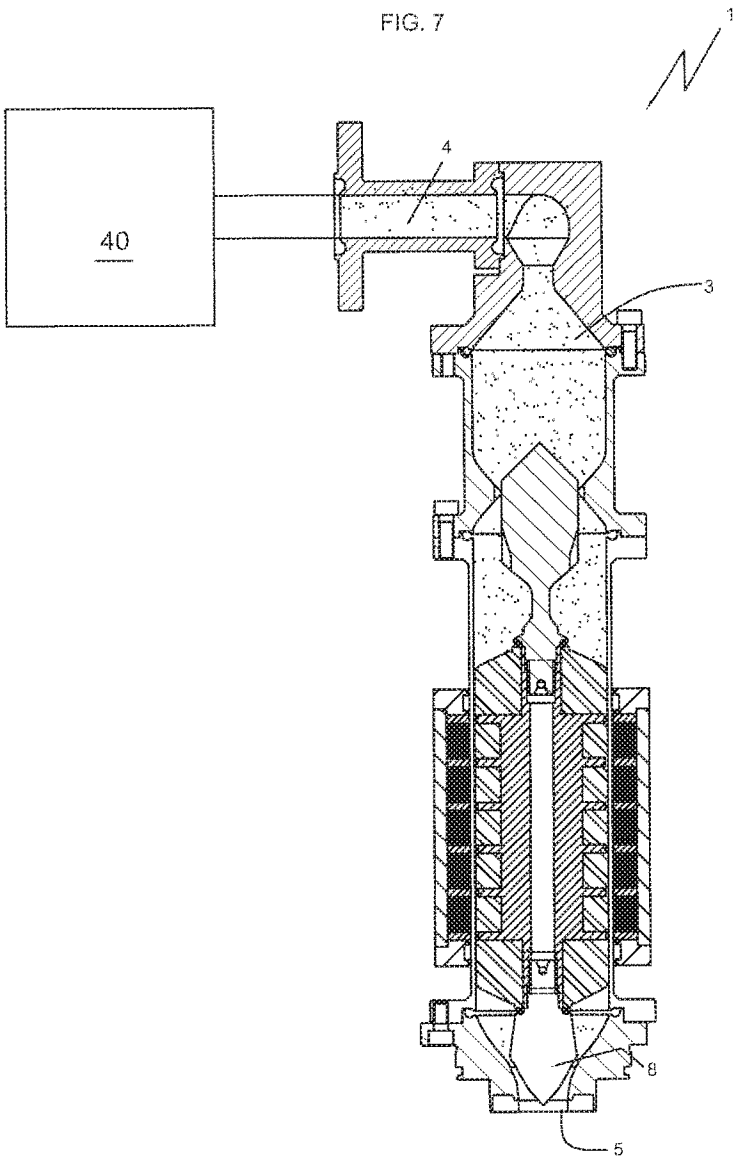
FIG. 7 illustrates the filling device of FIG. 1-3 in a sanitisation or condensate discharge status.

The third position, illustrated in FIG. 7, corresponds to a condensate discharge status.

The step of bringing the shutter 8 from the second position (sanitisation status) to the third position (condensate discharge status) can be performed periodically.

Alternatively, the condensate discharge is performed only as needed. In such a case, a step of detecting the presence of condensation inside the valve body 2 is envisaged. In response to the detection of condensation, the shutter 8 is brought from the second to the third position. The detection of condensation can be performed by means of a temperature sensor of a known type.

In accordance with a second embodiment, the sanitisation process of the filling device 1 comprises the steps of:

- bringing the shutter 8 into the third position, thus to the second predefined distance from the dispensing nozzle 5;
- supplying the inlet 4 with the sanitisation fluid so as to fill the valve body 2 with the fluid;
- evacuating the condensation that has formed inside the valve body 2.

In this second embodiment of the process, the evacuation of condensation is preferably performed without further distancing the shutter 8 from the dispensing nozzle 5 relative to the second predefined distance.

Should the conditions thus require, the evacuation of condensation could be performed by further distancing the shutter 8 from the dispensing nozzle 5 relative to the second predefined distance. For example, this further distancing could take place so as to free the passage section between the shutter 8 and the dispensing nozzle 5 from clogging by material (e.g. lumps or pieces of food).

Maintaining the shutter 8 in the condition of being further distanced from the dispensing nozzle 5 can have a predefined duration (in any case such as to enable unclogging of the passage section for the condensation). Alternatively, the further distancing is performed periodically.

It should be noted that in the second embodiment the dispensing nozzle 5 is never completely closed during the sanitisation treatment. The second predefined distance (which, we again note, refers to the third position of the shutter 8) is selected so as to guarantee the maintenance of saturation pressure and temperature inside the valve body 2.

The sanitisation fluid can be hot water, steam or VHP. It should be noted that, in this context, sanitisation fluid can mean either a fluid containing a sterilising substance or a cleaning fluid.

In accordance with a variant embodiment, in order to have a sterilisation of the dispensing area exposed to the outside environment, it is further possible to envisage a step of sterilising the dispensing nozzle 5 from the outside of the valve body 2, in the direction of the shutter 8.

For example, the sterilisation step can take place by nebulising a sterilising fluid on the dispensing nozzle 5 so that the jet is at least partially directed towards the shutter 8.

Alternatively, the sterilisation could take place by localised emission of radiation.

The step of sterilising the dispensing nozzle 5 from the outside of the valve body 2 preferably takes place at least partially at the same time as the step of supplying the inlet 4 with the sanitisation fluid.

The filling machine (not illustrated) proposed here comprises a plurality of filling stations, in each of which there is a filling device in accordance with the present invention.

The filling machine is preferably of the rotating carousel type. Alternatively, the filling machine is of the linear type.

The operation of the filling device for filling a receptacle, according to the present invention, is described below.

On arriving in the filling station, the receptacle is positioned under the corresponding filling device 1. Depending on the specific application, the mouth of the receptacle can be in contact with the dispensing nozzle 5 or it can be distanced from the latter.

The shutter 8 is in the open configuration, so the dispensing of fluid into the underlying receptacle is enabled.

During a first so-called "high flow rate" filling step, the flow rate selector 9 is in the second engagement configuration, illustrated in FIG. 2. In particular, the flow rate selector 9 engages the section narrowing 10 and is maintained mainly in the first chamber 11. The fluid flows over the walls of the flow rate selector 9 which delimit the grooved recess 9*c* on the second ogival end 9 and arrives, by gravity, at the dispensing nozzle 5, from which it is dispensed to the underlying receptacle.

On reaching a pre-established threshold value (level or weight) of the fluid dispensed into the receptacle, as detected by a sensor (not illustrated), the stepper motor makes the annular sleeve 13 slide downwards, i.e. in the direction of the dispensing nozzle 5. Thanks to the magnetic coupling, the slider 7, in turn, moves in that direction so that the flow rate selector 9 passes from the second to the first engagement configuration, illustrated in FIG. 1. In particular, the flow rate selector 9 is positioned in the section narrowing 10 substantially halfway between the first chamber 11 and the second chamber 12. Thus begins a second so-called "low flow rate" filling step, which allows the filling of the receptacle to be completed while reducing the turbulence of the fluid.

In fact, the grooved recess 9*c* of the second ogival end 9*b* of the flow rate selector 9 is positioned under the section narrowing 10, whereas the minimum space is defined by the groove 110*a* afforded in the thickening 110. The flow rate is thus reduced.

Similarly, the variant of FIG. 5 envisages reducing the flow rate by creating the minimum space by means of the longitudinal grooved recess 9*d* obtained in the flow rate selector 9.

Should it be necessary to dispense a fluid with solid pieces, the stepper motor makes the annular sleeve 13 slide upwards, i.e. in the direction of the section narrowing 10. Thanks to the magnetic coupling, the slider 7, in turn, moves in that direction, so that the flow rate selector 9 assumes the third configuration, illustrated in FIG. 3. In particular, the flow rate selector 9 is positioned entirely in the first chamber 11 so as not to engage the section narrowing 10.

This allows the passage of solid pieces through the section narrowing 10. From the description, the features of the filling device for filling a receptacle and of the process for the sanitisation thereof, according to the present invention, are clear, as are the advantages thereof.

In particular, the sanitisation treatment is performed simply by modifying the position of the shutter. It is not necessary to provide external actuation means or devices, which thus reduces the overall dimensions and the structural complexity compared to the prior art.

The movable element inside the valve body (slider with flow rate selector) also performs the function of regulating the flow rate in a gradual and calibrated manner according to the type of application.

The invention claimed is:

1. A filling device (1) for filling a receptacle, comprising:
- a tank (40) containing a fluid;
- a valve body (2) which mainly extends along a longitudinal direction (AA);
- an inlet (4) communicating with said tank (40);
- a dispensing nozzle (5) for dispensing fluid to the receptacle;
- a passage (3) for the fluid, obtained inside the valve body (2) between the inlet (4) and the dispensing nozzle (5);
- a shutter (8) that can be moved inside said valve body (2) so as to assume at least a first position in which it is at a first predefined distance from said dispensing nozzle (5), a second position in which it engages said dispensing nozzle (5) so as to close it completely and a third position in which it is at a second predefined distance from said dispensing nozzle (5), less than the first predefined distance;
- a slider (7) slidably inserted in the valve body (2), said shutter (8) being integrally fixed to a first end (7*a*) of the slider (7) in proximity to the dispensing nozzle (5);
- an annular sleeve (13) slidably mounted outside the valve body (2) and comprising a plurality of magnetic rings (14) alternating with a plurality of ferromagnetic rings (15), said slider (7) comprising a core (17) made of ferromagnetic material to which a coating (18) is applied made of thermoplastic polymer,
- wherein the core (17) of said slider (7) has a central portion (17*a*) having a cylindrical extension along said longitudinal direction (AA) and a plurality of radial projections (17*b*) having an extension orthogonal to the longitudinal direction (AA),
- said filling device (1) being configurable at least in:
  - a filling status in which the tank (40) contains a food-grade fluid and the shutter (8) is in the first position so as to allow the dispensing nozzle (5) to dispense the food-grade fluid to the receptacle;
  - a sanitisation status in which the tank (40) contains a sanitisation fluid and the shutter (8) is in the second or third position,
    - wherein the filling device (1) further comprises a flow rate sector (9) integrally fixed to a second end (7*b*) of the slider (7) and configured to assume at least one engagement configuration with a section narrowing (10) afforded in said passage (3), said section narrowing (10) being defined by a thickening (110) localised transversally to the walls of the valve body (2) and being interposed between a first chamber (11) receiving the fluid from the inlet (4) and a second chamber (12) receiving the fluid from the first chamber (11).

2. The filling device (1) according to claim 1, wherein said third position corresponds to a condensate discharge status for discharging the condensation that has formed inside the valve body (2).

3. The filling device (1) according to claim 1, wherein between said radial projections (17*b*) there are spaces or gaps (20) filled by said coating (18).

4. The filling device (1) according to claim 1, wherein each ferromagnetic ring (15) faces a group of radial projections (17*b*) located at the same height relative to the slider (7), a wall (19) of the valve body (2) being interposed between said ferromagnetic ring (15) and the radial projections (17*b*) of said group.

5. The filling device (1) according to claim 1, wherein said coating (18) is made of PEEK.

6. A sanitisation process for sanitising the filling device (1) according to claim 1, comprising the subsequent steps of:
- bringing the shutter (8) into the second position whereby it engages said dispensing nozzle (5) so as to close it completely;
- supplying the inlet (4) with the sanitisation fluid so as to fill the valve body (2) with said sanitisation fluid;
- bringing the shutter (8) from the second to the third position so as to discharge the condensation that has formed inside the valve body (2).

7. The process according to claim 6, wherein the step of bringing the shutter (8) from the second to the third position is performed periodically.

8. The process according to claim 6, further comprising a step of detecting the presence of condensation inside the valve body (2), the shift of the shutter (8) from the second to the third position taking place in response to the detection of condensation.

9. A sanitisation process for sanitising the filling device (1) according to claim 1, comprising the subsequent steps of:
- bringing the shutter (8) into the third position;
- supplying the inlet (4) with the sanitisation fluid so as to fill the valve body (2) with said sanitisation fluid;
- evacuating the condensation that has formed inside the valve body (2).

10. The process according to claim 9, wherein the step of evacuating the condensation is performed without further distancing the shutter (8) from the dispensing nozzle (5) with respect to said second predefined distance.

11. The process according to claim 9, wherein the step of evacuating the condensation is performed by further distancing the shutter (8) with respect to said second predefined distance.

* * * * *